US005127114A

United States Patent [19]

Hörburger

[11] Patent Number: 5,127,114

[45] Date of Patent: Jul. 7, 1992

[54] LATH GRATING FOR SUPPORTING MATTRESSES

[76] Inventor: Reinhard Hörburger, Bregenzerweg 5, A-6833 Klous, Austria

[21] Appl. No.: 802,128

[22] Filed: Dec. 3, 1991

[30] Foreign Application Priority Data

Dec. 6, 1990 [AT] Austria ..... 2474/90
Sep. 9, 1991 [AT] Austria ..... 1775/91

[51] Int. Cl.[5] ..... A47C 23/06

[52] U.S. Cl. ..... 5/239; 5/238; 5/615

[58] Field of Search ..... 5/236.1, 238, 239, 241, 5/244, 66, 453

[56] References Cited

U.S. PATENT DOCUMENTS 4,309,783 1/1982 Commack et al. ..... 5/453 X
4,477,935 10/1984 Griffen ..... 5/236.1 X
4,839,932 6/1989 Williamson ..... 5/453 X
5,038,429 8/1991 Elmalek et al. ..... 5/238 X
5,050,224 10/1991 Achwanden et al. ..... 5/238
5,070,560 12/1991 Wilkonson ..... 5/236.1 X

FOREIGN PATENT DOCUMENTS 0038155 10/1981 European Pat. Off. ..... 5/238

*Primary Examiner*—Michael F. Trettel
*Attorney, Agent, or Firm*—Akoo-Toren

[57] ABSTRACT

A lath grating for the support of mattresses or the like includes a frame and a plurality of laths arranged parallel to each other. Vertical supporting shafts are arranged at both ends of the lath. The supporting shafts are connected to the lath in an articulated manner and are received by vertical guide bore holes provided in a row at the upper sides of the frame legs which extend in longitudinal direction of the lath grating. Longitudinally extending chambers are cut out in the frame legs. A device for supporting the supporting shaft in a spring-like manner and including inflatable tube-like bellows is provided in the chambers. The chambers are tubular and the inflatable bellows directly contact the wall of the tubular chambers along the entire surface thereof as a result of the pressure prevailing in the bellows. The supporting shafts directly contact the bellows. The bellows are connected via regulating members to at least one pressure tank.

20 Claims, 4 Drawing Sheets

LATH GRATING FOR SUPPORTING MATTRESSES

BACKGROUND OF THE INVENTION

1. Field of the Invention

The invention relates to a lath grating for supporting mattresses or the like. The lath grating includes a frame with frame legs and a plurality of laths which are arranged parallel to one another. Vertical support shafts are arranged at both ends of the lath. The supporting shafts are connected with the laths in an articulated manner and are received by vertical guide bore holes provided in a row on the upper side of the frame legs which extend in longitudinal direction of the lath grating. Longitudinally extending chambers are cut out in the frame legs. Means for supporting the supporting shafts in a spring-like manner and which include inflatable tube-like bellows are provided in the chambers.

2. Description of the Related Art

In a lath grating construction of this kind described in German Offenlegungsschrift 38 27 476, the supporting shafts of the laths contact an endless, tensioned belt which is guided around a plurality of rollers. An inflatable bellows is provided below the belt for tensioning same, which bellows directly contacts the underside of the endless belt. This bellows lies in a longitudinally extending rectangular chamber. The tensioning of the endless belt which is guided over rollers is to be regulated by means of this bellows. This construction is not advisable for several reasons: in terms of construction it requires a large overall height because the endless belt, which is guided over rollers, and the bellows are arranged one above the other; the construction cost in this case is high because of the rollers and the endless belt; the softness which can be achieved in principle by an air suspension and the support which can be regulated to a great extent are canceled out by the circumferentially extending belt, so that this previously known construction as a whole is not advisable.

A lath grating whose frame sides are constructed as channel-like grooves is known from U.S. Pat. No. 4,525,886, wherein the side pieces which laterally define these channel-like grooves comprise vertical slots. Tubes are placed in the two channel-like grooves. The ends of the laths of the lath grating carry laterally projecting bearing journals which are placed in open grooves of bearing shells. The bearing shells, in turn, are placed on the tubes. A tube consisting of a very rigid material with little elasticity must be used in this case, so that the tube which is loaded and under pressure is not squeezed up between the bearing shells which succeed one another at intervals. Accordingly, the softness which is achievable, per se, by air suspension and the easy adjustability of the support are negated by the hard material of the tube which must necessarily be used in this case.

European Patent 116 237 and European Application 161 392 also show and describe a lath grating. These known lath gratings comprise two tube-like bellows which lie parallel to one another and at a distance from one another horizontally; at the upper side of the latter are fastened flat strips extending along the bellows which comprise pocket-like recesses in which the ends of the laths forming the lath grating are inserted. The entire width of the individual laths directly contacts the aforementioned bellows and, as tests have shown, the spring characteristic of this construction is considerably impaired by the large support surface of these laths.

The springing suspension and support of the laths of the lath grating would be ideal if every supporting shaft were constructed as a piston-cylinder unit, wherein all of these piston-cylinder units would communicate with one another pneumatically. Such a solution has already been proposed in German Offenlegungsschrift 38 27 476, but the construction cost involved is much too high and the construction is accordingly too expensive, so that such a suggestion has thus far not been put into practice.

SUMMARY OF THE INVENTION

Starting from this prior art, it is the object of the invention not only to improve the spring characteristics of such a lath grating, but also to construct the lath grating in another embodiment of the invention in such a way that its springing behavior can be changed quickly and without further effort so as to adapt the lath grating to the respective load conditions within the shortest possible time.

In accordance with the invention, the chambers are constructed so as to be tubular and the inflatable bellows directly contact the wall of the tubular chambers along the entire surface thereof as a result of the pressure prevailing in the bellows. The supporting shafts directly contact the bellows and the bellows are connected by a regulating means to at least one pressure tank.

As a result of the features of the invention, the elastic inflatable bellows which is enclosed by the tubular chamber and contacts the wall of the latter can be constructed from a soft and, above all, elastically deformable material so that the material of the bellows has no significant influence on the springing characteristics of the air cushion. Thus, the supporting shaft works in the same manner as the piston of a pneumatic piston-cylinder unit.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
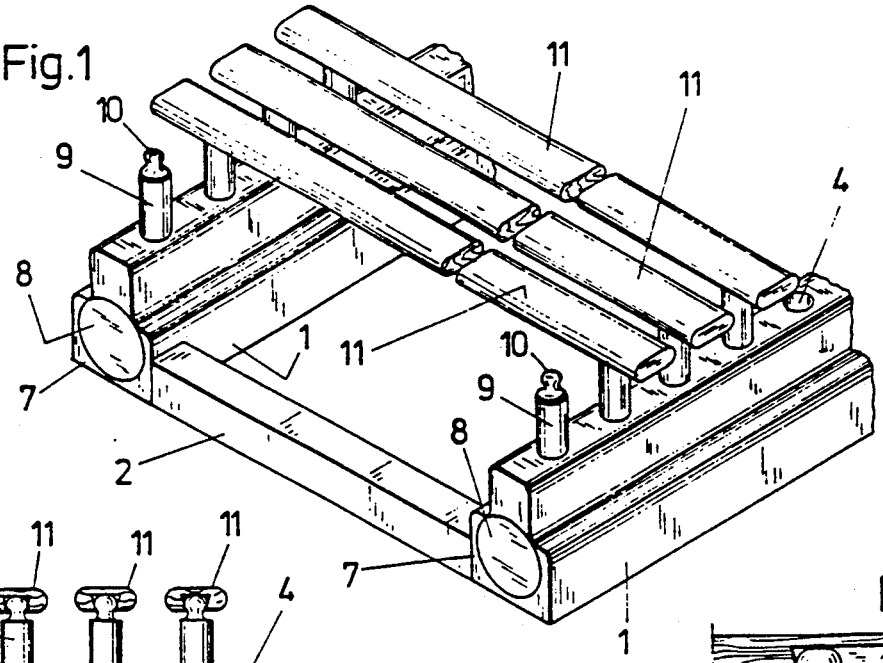
FIG. 1 is a schematic perspective view of a portion of a lath grating according to the present invention.
Figure 2:
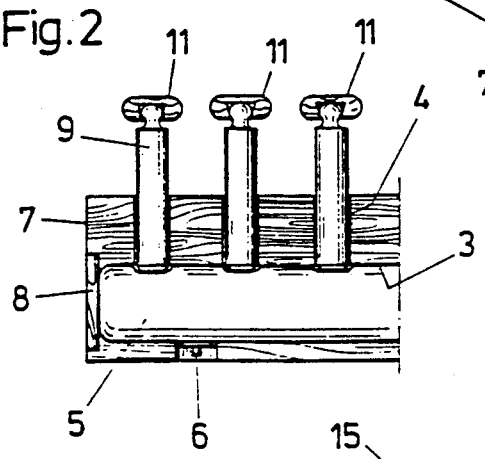
FIG. 2 is a longitudinal sectional view, on a large scale, through a frame leg and a tubular chamber.
Figure 5:
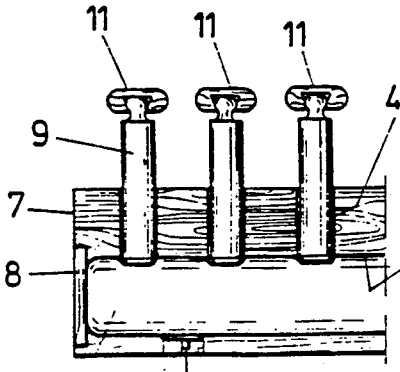
FIG. 5 is a longitudinal section similar to FIG. 2, but in this case connected with a circuit provided for regulating and influencing the pressure.

The lath grating according to the invention, as shown in FIG. 1 in a perspective view, includes a frame which is rigid and is formed by the two longitudinally extending frame legs 1 and by crossbeams 2. As can be seen from FIG. 1 and also from FIG. 6, the two frame legs 1, which are constructed in this instance as wooden beams, have a substantially T-shaped cross section, wherein these beams are penetrated along their length by an approximately cylindrical chamber 3, the chamber 3 lying approximately in the horizontal portion of this cross section. In the upper portion of the wooden beam 1, i.e. in the vertical portion of this cross section, a plurality of vertically extending guide bore holes 4 are provided at equal intervals and open into the aforementioned chamber 3. As shown in FIG. 5, an inflatable tube-like bellows 5 comprising a valve 6 which is accessible from the outside is located in the chamber 3. The front sides 7 of the wooden beams 1 are closed in a suitable manner by a cover 8. The pressure prevailing in the bellows 5 is sufficiently great so that the entire surface of the bellows constantly contacts the wall of the chamber 3.

Supporting shafts 9 whose cross section corresponds to the cross section of the guide bore holes 4 and whose axial length is approximately twice as great as the axial length of the guide bore holes 4, are inserted into the vertical guide bore holes 4 with corresponding play enabling their free movability, the quantity of guide bore holes 4 corresponding to the quantity of laths 11.

Figure 6:
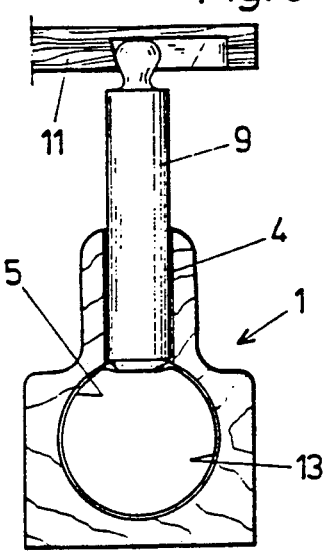
FIG. 6 is a cross sectional view, on a larger scale, through the frame leg constructed as a wooden beam in the area of a support journal.

The upper end of the individual supporting shafts 9 is formed by a ball pivot 10; the inner or lower end of every supporting shaft 9 directly contacts the tube-like bellows 5, as shown in FIG. 6. The ball pivot 10 at the upper end of every supporting shaft 9 serves to receive an end portion of a lath 11 so as to be movable. A keyhole-like milled out portion 12 is provided for this connection at the underside of every lath 11, wherein the side surfaces 13 of the portions 14 of this cut out portion 12 which extend substantially parallel to one another are arranged so as to be inclined in order to form an undercut groove 15, wherein these inclined side surfaces 13 converge at the bottom, as can be seen in FIG. 3.

Figure 3:
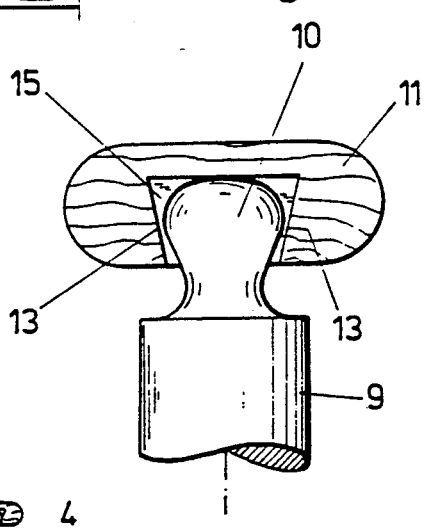
FIG. 3 is a cross sectional view, on a large scale, through a lath in an area in which it is carried by a supporting shaft.

As FIG. 3 shows in this respect, an articulated connection is provided in this manner between the supporting shaft 9 and lath 11 which offers the lath 11 a great degree of freedom.

The axes of the keyhole-like cut out portions 12 extend parallel to the longitudinal axis of the laths 11. The keyhole-like cut out portions 12 provided at the end of every lath 11 are directed toward one another by their portions 14 forming the undercut grooves 15.

Figure 4:
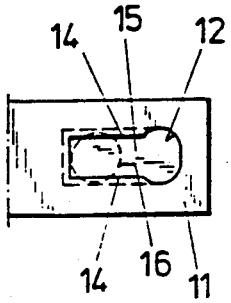
FIG. 4 is a view from below of an end portion of a lath.
Figure 4:
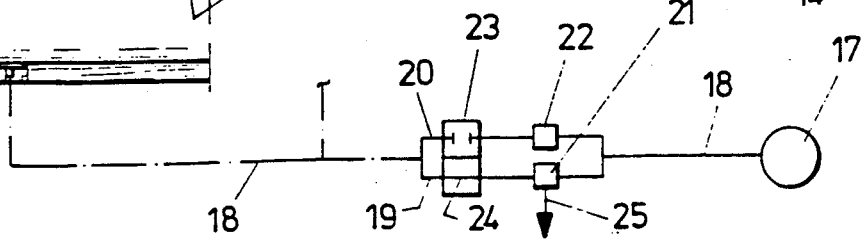

The manner of operation of this lath grating follows directly from its construction. The tube-like bellows 5 are enclosed on all sides by the chambers 3 receiving them and constantly closely contact the wall of the latter because of the pressure prevailing in them, so that they cannot be deflected or increase in volume regardless of the pressure prevailing in them at a given time. The individual supporting shafts 9 contact the bellows 5 along a relatively small surface area corresponding to their cross section which is in turn dimensioned so as to be small in comparison with the end portion of a lath 11, as shown by broken line 16 in FIG. 4. This favorably influences the springing behavior of the bellows which is under pressure. These bellows 5 can be inflated and put under pressure via the valves 6 which are accessible from the outside, wherein the extent of pressure prevailing in the bellows 5 determines the spring characteristic of the grating and can be selected individually.

The tube-like bellows 5 are connected to at least one pressure tank 17 shown in FIG. 5, so that this springing behavior can be changed quickly as a function of the respective load and force applied to the grating.

A line portion comprising two parallel line branches 19, 20 is provided in a line 18 connecting the bellows 5 and pressure tank 17. A pressure reducing valve 21, 22 and a stop valve 23, 24 are provided in series in each of the line branches 19, 20. The pressure reducing valves 21 and 22 can advisably be regulated. The pressure reducing valves 21 and 22 are adjusted to different values and the pressure reducing valve 21 having the lower adjustment value comprises a vent bore hole 25. The stop valves 23, 24 provided in the parallel line branches 19, 20 are coupled with one another, one of them being in the open position while the other is closed, and vice versa. While the structural component parts discussed here, i.e. stop valves and pressure reducing valves, are shown in FIG. 5 as separate structural members, it is certainly possible, and also is within the framework of the invention, to integrate these four structural component parts in a joint uniform structural member.

Assuming that a predetermined pressure which can be built up manually or mechanically via a connectable pump prevails in the pressure tank, the following steps can be carried out with the circuit shown in FIG. 5. The pressure reducing valves 21 and 22 are adjusted to different pressures, wherein the adjustment value of the pressure reducing valve 21 is lower than that of the pressure reducing valve 22. Further, if the valve 24 is open the stop valve 23 is closed. The pressure prevailing in the bellows 5 is that pressure which is predetermined by the pressure reducing valve 21 and is lower than the pressure predetermined by the pressure reducing valve 22.

If the spring suspension of the lath grating is strengthened or stiffened, i.e. the springiness is to be increased, since the lath grating is loaded to a greater extent, the stop valve is actuated by the user of the lath grating in such a way that the stop valve 24 is now closed and the stop valve 23 is opened. The adjustment of the pressure reducing valve 22 determines the pressure and, because of the aforementioned higher adjustment, the pressure in the bellows 5 increases; only a small handle for the user or users of the lath grating is needed for this purpose.

If the lath grating is adjusted again to its original spring suspension, the stop valve 23–24 is actuated again, wherein the stop valve 23 is now closed and the stop valve 24 is opened. The increased pressure value prevails at first in the line branches 18, 19, 20, which pressure, however, has now dropped to the adjustment value of the pressure reducing valve 21 via the vent opening 25, specifically until the original pressure corresponding to the adjustment value of the pressure reducing valve 21 has been reached again. Because of the pressure tank 17 provided here, this adjustment can be repeated often. The pressure tank must be recharged now and then.

The two bellows 5, a pair of which is provided for every lath grating, can be connected to an individual control device of the type described here, so that identical pressure conditions prevail in the two bellows assigned to one lath grating. It is possible, in addition, to provide every bellows 5 with such a control device with the result that the pressure conditions in each of the two bellows assigned to a lath grating can be regulated individually independently of one another.

Figure 7:
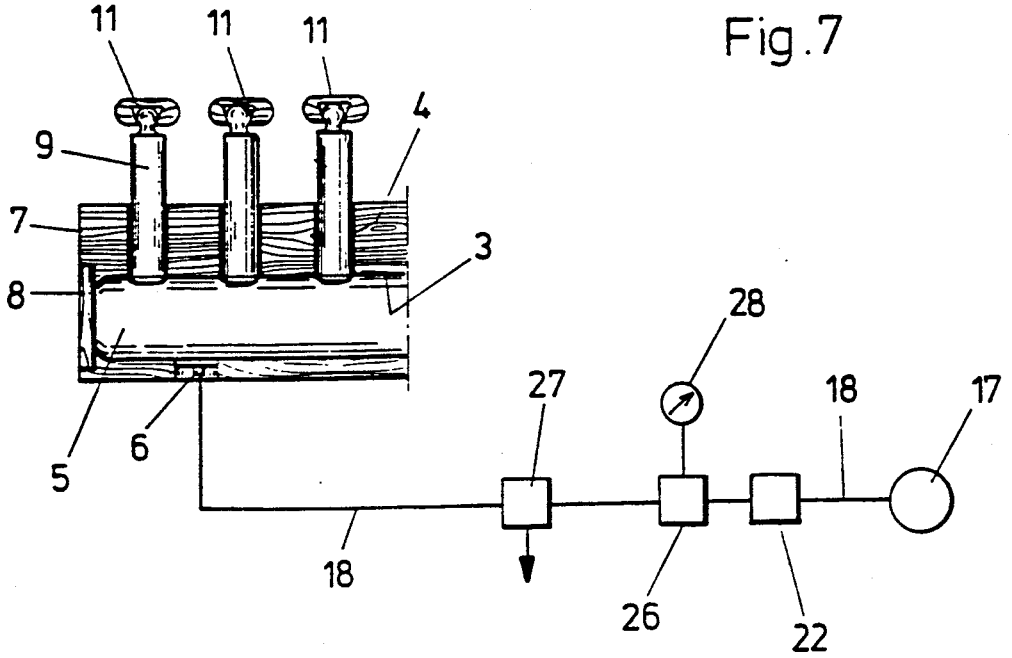
FIG. 7 is a view similar to FIG. 5 showing another embodiment.

FIG. 7 shows a variant of FIG. 5: in this case, a filling valve 26 is provided in the line 18 connecting the bellows 5 and the pressure tank 17, as is a vent valve 27 and a manometer 28 which is advisably connected in such a way that its feed line is blocked when the filling valve 26 is open and is open when the filling valve 26 is closed again. The manometer or pressure gauge 28 indicates the prevailing pressure in every branch of the line 18 running between the bellows 5 and the filling valve 26. The scale of this pressure gauge 28 is advisably calibrated in weight units. If the pressure prevailing in the bellows 5 is to be lowered, the vent valve 27 is actuated until the pressure in the bellows is reduced to the desired extent. The filling valve 26 and vent valve 27 are advisably manually actuated. In principle, this circuit is constructed in the same way as the pump devices provided in filling stations for inflating vehicle tires. A reducing valve 22 can also be arranged downstream in the pressure tank 17.

It was mentioned with reference to the illustrated embodiment that the frame legs 1 on which the laths 11 are supported are formed by wooden beams. It is within the scope of the invention to fashion these structural component parts serving to receive the bellows 5 e.g. from metal box sections or plastic profiles, a round cross section for the chambers 3 receiving the bellows 5 not being substantial to the invention. This cross section can also be shaped differently, e.g. as a rectangle or polygon.

A single-walled tube is shown in the illustrated embodiment. This tube can also be double-walled, wherein this double wall can extend along the entire circumference of the tube or only along a portion of the circumference, e.g. over the region lying above or below. Both of the chambers formed by the double wall are under pressure. It is also possible to arrange tube-like cushions on the laths 11, which cushions extend along the length and width of the lath supporting surface and whose hollow spaces are in connection with one another and are likewise inflatable.

In order to adjust a portion of the support surface of the lath grating, e.g. the head part and/or the foot part of the lath grating, at an inclination relative to the horizontal line, it is further provided that the chambers 5 are constructed in a tubular manner and the inflatable bellows 5 directly contacts the wall of the tubular chambers 3 along its entire surface as a result of the pressure prevailing in it, and the supporting shafts 9 directly contact the bellows 5, and the tube-like bellows 5 are connected via regulating members to at least one pressure tank 17.

Figure 8:
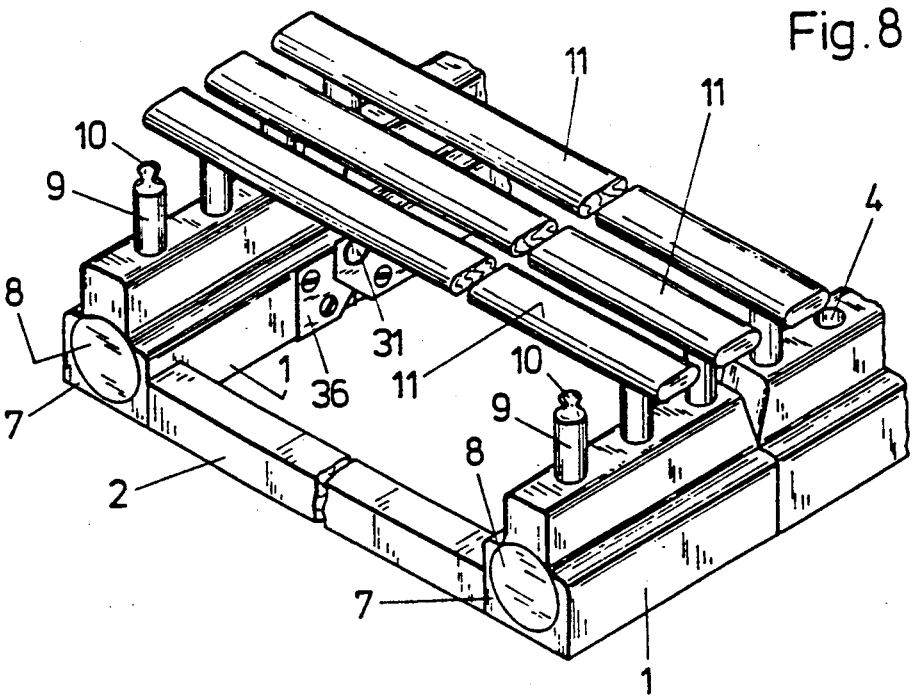
FIG. 8 is a schematic perspective view of a subdivided lath grating.

If the chamber 3 and frame leg 1 are constructed in one piece as shown in FIG. 1, the laths 11 form a one-piece support surface. It is often necessary to adjust at least one end portion of such a lath grating so as to be inclined relative to the other portion with respect to the horizontal. For this purpose, the chambers 3 and the frame legs 1 are divided into at least two portions along the length of the lath grating and the abutting regions of the chambers or frame legs succeeding one another in a row are connected with one another in a hinge-like manner as illustrated in FIG. 8, wherein an additional freely inflatable bellows 30 is provided, by means of which the desired inclination can be adjusted. Freely inflatable bellows 30 means that the bellows 30 mentioned here can freely change its volume as a function of the pressure prevailing in it and is not locked into a circumferentially closed chamber.

Figure 9:
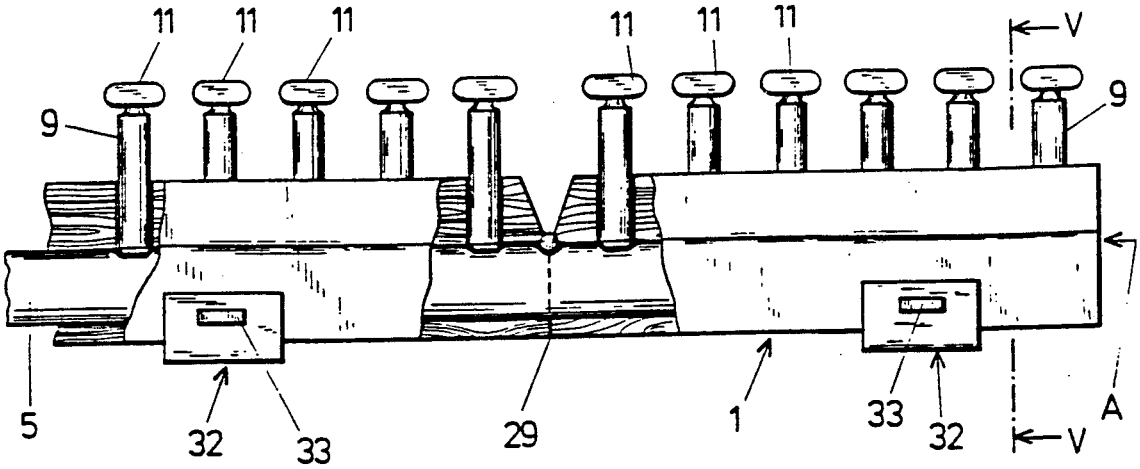
FIG. 9 shows a connection of two portions forming a lath grating, partially broken away.
Figure 14:
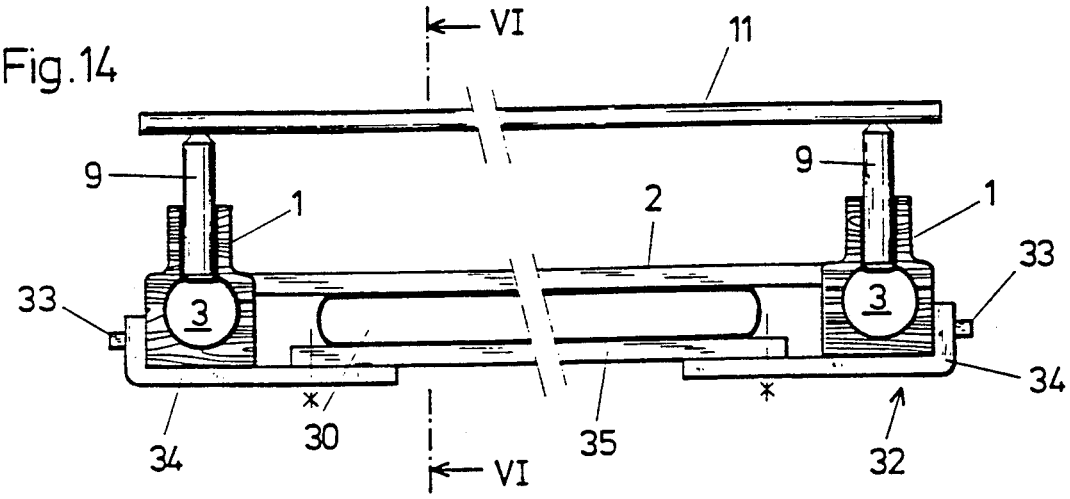
FIG. 14 is a view of the lath grating according to FIG. 9, shown in section along line V—V and in the viewing direction of arrow A of FIG. 9.

FIG. 9 shows such a point at which two chambers or frame legs succeeding one another in a row abut against one another, wherein the abutting portions of the frame legs 1 intersect in a V-shape in the region of the hinge axis 31 proceeding from the upper side. U-shaped cross-ties 32 which can be arranged with external strips or pins 33 in a bed frame, not shown, form the supports for the lath grating. These U-shaped cross-ties 32 which can be inserted in the bed frame in the manner of a hinge are constructed in a plurality of parts. They comprise two L-pieces 34 on the ends and a straight-edge intermediate piece 35, wherein these pieces are connected with one another via elongated recesses and screws. Thus, the length of these U-shaped cross-ties can be changed without special expenditure. These cross-ties can accordingly be adapted to the respective clear width of a bed frame.

The aforementioned additional freely inflatable bellows 30 (FIG. 6) which is connected with the pressure tank 17 (FIG. 5 or 7) via a valve and regulating element, not shown, lie between such a cross-tie 32, which serves as an abutment, and a crossbeam 2 which connects adjacent chambers or frame legs 1 with one another. This bellows 30, which can be inflated or swelled up, is connected with the underside of the crossbeam 2 and freely contacts the cross-tie 32.

Figure 12:
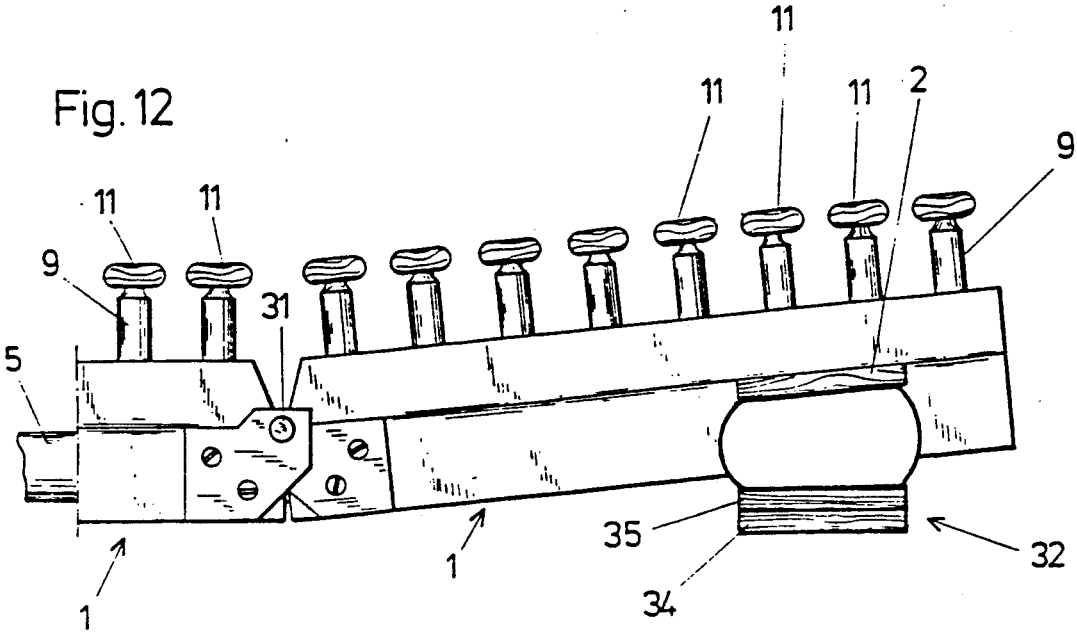
FIG. 12 is a view corresponding to FIG. 11, but with portions inclined relative to one another.
Figure 10:
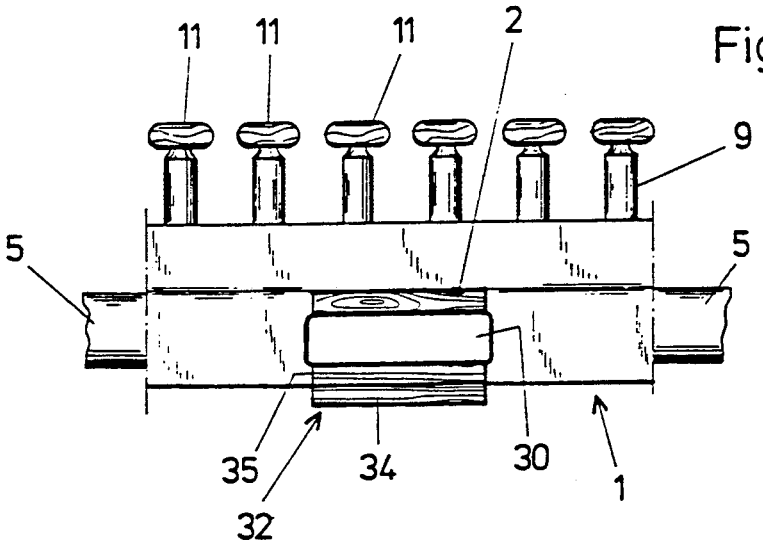
FIG. 10 is a cross sectional view along line VI—VI in FIG. 14.

When the additional bellows 30 is deflated (FIG. 10), the chambers or frame legs 1 rest on the cross-ties 32. When the bellows 30 is filled with air, it inflates freely and in so doing lifts the part of the lath grating supported by it (FIG. 12).

Figure 11:
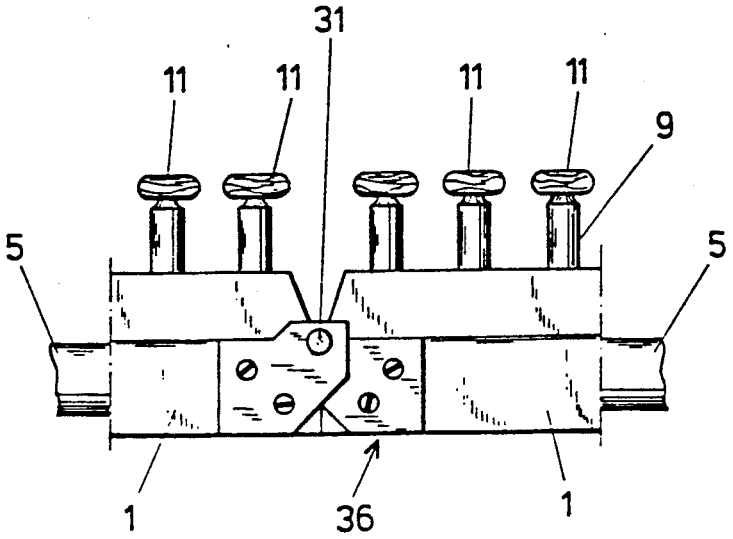
FIG. 11 is a view of a hinge-like fitting at the connecting point.

The beams or chambers 3 (FIGS. 11 and 12) which follow one another in a row are connected with one another in the manner of hinges via fittings 36. These fittings 36 are provided at the facing inner sides of the chambers or frame legs 1, so that the outer width of the lath grating is not altered by this lateral arrangement of the fittings.

When the abutting front sides 29, the hinge-like fittings 36 and the bellows 30 are constructed in such a way that only a defined adjustment angle is provided between the support parts of the lath grating, the two adjoining chambers or frame legs 1 are penetrated by an individual bellows 5, as shown in FIG. 9. This tube-like bellows 5 can easily follow the aforementioned inclination adjustment of the chambers or beams.

Figure 13:
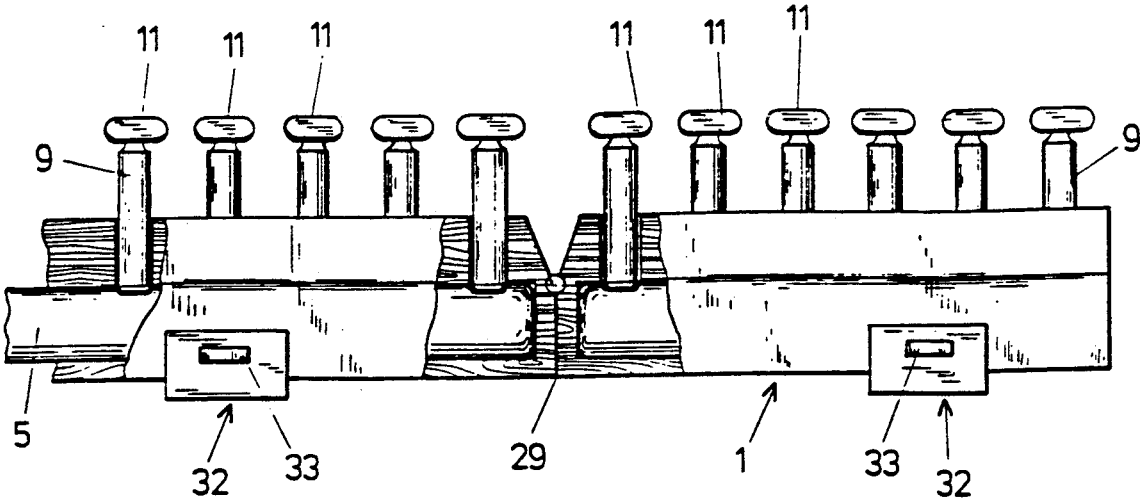
FIG. 13 shows a detail from the view according to FIG. 9.

However, if it is provided that the two support parts of the lath grating can be adjusted at a larger angular area relative to one another, e.g. when the lath gratings are used in hospital beds in which it is necessary that the head part can be swiveled up by almost 90° relative to the horizontal, the two adjacent front sides 39 of the chambers 3 or frame legs 1 are closed and an individual tube-like bellows 5 is provided in every chamber or in every beam as shown in FIG. 13, wherein these two bellows are connected to the same line 18.

As a result of the suggestion according to the invention, it is possible to adjust at least a portion of the support grating at an angle relative to the other portion. It is within the scope of the invention also to construct the lath grating in three parts in the described manner, wherein the outer or end portions can be inclined relative to the horizontal. The multiple-part cross-ties 32, as well as the fittings 36, can be manufactured entirely of wood. As a result of the suggestion according to the invention, the energy serving to influence the spring characteristic of the support grating can also be utilized for adjusting the inclination of a portion of the support surface.

If the laths 11 are loaded approximately in the center when using the lath grating, the support pressures are substantially identical at both sides and the penetrating depths of the supporting shafts 9 are accordingly also identical at a given pressure in the bellows 5. However, if the loading is shifted to the side, the support pressures, and accordingly the penetrating depths of the supporting shafts 9, change to the extent of the lateral shifting of weight so that the lath 11 affected by it slopes diagonally somewhat, i.e. one frame leg is inclined relative to the other frame leg. It is possible to install sensors in portions of the frame legs, which sensors measure the extent of the penetration depth of the supporting shafts 9 which are assigned to a lath 11 or to a group of laths; when unequal penetration depths are determined as a result of the aforementioned asymmetrical load distribution or as a result of changing the lying position e.g. from the back to the side or stomach position, the sensors ensure a change in pressure in the bellows 5 of the frame legs 1 via a regulating or control device, so that the deeply penetrating supporting shaft 9 is lifted and/or the higher supporting shaft is lowered. The area of the lath grating which is regulated and controlled in this manner then also comprises a separate bellows 9, since the pressure conditions on both sides of the frame are to be influenced in the described manner over only a part of the length of the lath grating.

While specific embodiments of the invention have been shown and described in detail to illustrate the inventive principles, it will be understood that the invention may be embodied otherwise without departing from such principles.

I claim:

1. In a lath grating for the support of mattresses or the like, the lath grating including a frame with frame legs and a plurality of laths arranged parallel to one another, vertical supporting shafts being arranged at both ends of the laths, the supporting shafts being connected to the laths in an articulated manner and being received by vertical guide bore holes provided in a row at an upper side of the frame legs which extend in a longitudinal direction of the lath grating, longitudinally extending chambers being defined in the frame legs, means for supporting the supporting shafts in a spring-like manner and including inflatable tube-like bellows being provided in the chambers, the improvement comprising the chambers being tubular and the inflatable bellows directly contacting the entire inner wall surface of the tubular chambers as a result of pressure prevailing in the bellows, wherein the supporting shafts directly contact the bellows, and wherein the tube-like bellows are connected by a regulating means to at least one pressure tank.

2. The lath grating according to claim 1, comprising a line connecting the bellows and the pressure tank, the line comprising a line portion with at least two parallel line branches, each line branch having connected in series a pressure reducing valve and a stop valve.

3. The lath grating according to claim 2, wherein the pressure reducing valves are set at different values, and wherein the pressure reducing valve with the lower set value comprises a vent bore hole.

4. The lath grating according to claim 3, comprising coupling means for the stop valves provided in the parallel line branches for maintaining one of the stop valves in an open position and the other of the stop valves in a closed position.

5. The lath grating according to claim 2, comprising a filling valve and a vent valve in a line connecting the bellows and the pressure tank.

6. The lath grating according to claim 5, wherein the filling valve and the vent valve are manually adjustable.

7. The lath grating according to claim 5, comprising a pressure gauge in a branch line connecting the bellows and the filling valve and the vent valve.

8. The lath grating according to claim 7, wherein the pressure gauge comprises a scale indicating weight units.

9. The lath grating according to claim 1, wherein the frame legs are wooden beams having a T-shaped cross section with a horizontal portion and a vertical portion, the chambers receiving the bellows being provided in the horizontal portion and the guide bore holes being located in the vertical portion.

10. The lath grating according to claim 1, wherein the lath has at the ends and the undersides thereof keyhole-like cut out portions, each cutout portion having a section with side surfaces which extend essentially parallel to each other, the supporting shafts having upper ends configured as ball pivots, the side surfaces being inclined relative to each other so as to form an undercut groove, whereby the ball pivots are received in a positively locking manner by the groove.

11. The lath grating according to claim 10, wherein each keyhole-like cut out portion has an axis which extends parallel to the longitudinal axis of the lath, and wherein in each lath the sections of the keyhole-like cut out portions which form the undercut grooves are directed toward each other.

12. The lath grating according to claim 1, wherein the frame legs including the chambers are divided along the length of the lath grating into at least two portions having abutting front sides, the abutting front sides being connected together by hinge means, whereby the frame leg portions can be adjusted in inclination relative to each other, the lath grating comprising another bellows underneath at least one of the frame leg portions, the another bellows being inflatable and expandably mounted on a fixed abutment.

13. The lath grating according to claim 12, comprising a crossbeam for connecting oppositely located adjustable frame leg portions, the another bellows being attached to the crossbeam and an underside of the bellows resting on the fixed abutment.

14. The lath grating according to claim 13, wherein the fixed abutment is a U-shaped cross-tie adapted to be suspended in a bed frame.

15. The lath grating according to claim 14, wherein the U-shaped cross-tie comprises three parts including two L-shaped pieces at the ends thereof and a straight intermediate piece, the L-shaped pieces and the straight piece being connected to each other through screws engaging in elongated recesses.

16. The lath grating according to claim 15, wherein vertical portions of the L-shaped pieces are provided at outer sides thereof with strips or pins for suspending the U-shaped cross-tie in a bed frame.

17. The lath grating according to claim 12, wherein the hinge means at the abutting front sides of the frame leg portions include fittings which are mounted on inner sides of the chambers which face each other.

18. The lath grating according to claim 12, wherein the abutting front sides of the frame leg portions and the chambers are open with a single bellows extending through adjacent chambers.

19. The lath grating according to claim 12, wherein in abutting front sides of the frame leg portions and the chambers are closed with individual bellows being provided in each of the chambers.

20. The lath grating according to claim 12, wherein the another bellows is mounted in a section of the frame leg portion facing away from the hinge means.

* * * * *